United States Patent [19]

Trimboli Longhetto

[11] 4,302,949

[45] Dec. 1, 1981

[54] REFRIGERATION AND HEATING SYSTEM

[75] Inventor: Antonio A. Trimboli Longhetto, Madrid, Spain

[73] Assignee: Victor M. Oswald, Madrid, Spain

[21] Appl. No.: 105,934

[22] Filed: Dec. 21, 1979

[51] Int. Cl.[3] ..... F25D 9/00

[52] U.S. Cl. ..... 62/402; 62/5; 62/235.1

[58] Field of Search ..... 62/2, 86, 87, 88, 401, 62/402, 5; 60/641

[56] References Cited

U.S. PATENT DOCUMENTS

| | | | |
|---|---|---|---|
| 3,026,681 | 3/1962 | Green | 62/5 |
| 3,208,229 | 9/1965 | Fulton | 62/5 |
| 3,815,375 | 6/1974 | Inglis | 62/5 |
| 4,086,072 | 4/1978 | Shaw | 62/2 |

*Primary Examiner*—Ronald C. Capossela

*Attorney, Agent, or Firm*—Pennie & Edmonds

[57] ABSTRACT

A turbine assembly 100 is disclosed for dividing a stream of gaseous working fluid into two streams, one stream having a higher temperature than the other. A heating and refrigeration system incorporating the turbine assembly 100 is also disclosed.

11 Claims, 13 Drawing Figures

REFRIGERATION AND HEATING SYSTEM

DESCRIPTION

TECHNICAL FIELD

The present invention relates to heating and cooling in a controlled manner. The invention can be used, for example, for thermal conditioning of areas used for industrial purposes, and also for the air-conditioning of domestic environments. One of the principal features of the present invention is that, depending on the circumstances, it can be used for heating and cooling wherever there is a more or less constant source of heat.

DISCLOSURE OF INVENTION

The invention provides a system for the regulated and controlled production of heated and cooled fluids from a primary source of thermally attentuated heat, such as solar energy and the like. For example, the temperature range of the primary source could be from about 5° C. to about 20° C. The refrigeration and heating system is in thermal communication, directly or indirectly, with this primary source of heat. The refrigeration and heating system may take the form of an open system, i.e., the heat of the primary source is utilized directly by the system; or a closed system, in which the system comprises a closed circuit independent of the primary source, with which it is associated solely for the purposes of heat exchange.

In a preferred embodiment, the primary heat source consists of a solar heat circuit, which includes a battery of collector elements for solar heat energy. Heat from the solar heat circuit is transferred by means of a heat exchanger to a working fluid which circulates in the refrigeration and heating system.

A pressurizing tank is included in the system to serve as a reservoir for the fluid. At least a fraction of the working fluid in the pressurizing tank is in a gaseous state. As a result of the heating effected by the solar heat circuit, the pressure of the gaseous working fluid increases.

The invention is based on the properties of a thermally energized gas, which can be considered as comprising fast, or "hot", molecules and slow, or "cold", molecules. In particular, the invention makes use of a spatial distribution of these molecules, induced when the flow of the working fluid in the gaseous state is substantially accelerated and a vortex is brought about therein. Means are provided which tend to channel "hot" molecules in one direction and "cold" molecules in a different direction thereby at least partially separating the "hot" and "cold" molecules.

The gaseous working fluid placed under pressure in the pressurizing tank is injected into a turbine assembly wherein a separation of "hot" molecules from "cold" molecules is achieved by an effect of turbulence.

In a preferred form of practicing the invention, the turbine assembly comprises an inlet in the form of a Venturi tube and a turbine for molecular thermal separation. The Venturi tube is provided to inject gas at a high velocity into the turbine to generate and maintain the conditions of turbulence whereby molecular thermal separation is achieved. The turbine assembly further includes a generally T-shaped housing whose stem corresponds to the Venturi-tube inlet. The turbine is placed at the intersection of the stem and the two arms of the "T". The two arms carry the two thermally-separated streams of gaseous working fluid. The gas streams return from the two arms to the pressurizing tank through return conduits and a pumping mechanism. Heat exchange for utilizing the thermal separation achieved in the turbine assembly can take place during passage of the thermally-separated streams through the two arms of the T-shaped housing or the return conduits. For this heat exchange, heat exchangers provided with fins can be placed in thermal contact with the arms or conduits. Fans can be employed to improve the efficiency of the respective heat exchanges before the gas is returned to the pressurizing tank in order to restart the cycle. Other types of radiators or thermal convectors can be used, if preferred.

Valves or flow throttles can be provided at the ends of the arms of the T-shaped housing for regulation of the flow of the gaseous working fluid circulating in the turbine assembly. The flow-regulating valves act in the manner of throttles, achieving temperature control by increasing or decreasing the pressure at which the turbine operates, which results in increasing or decreasing the temperature difference between the two thermally separated streams of working fluid.

In general, the working fluid may be virtually any fluid having a gaseous phase under the operating conditions. Depending on the specific requirements of each use, different gases may be more advantageous in different cases. Suitable for use in many applications of the heating and cooling system are fluids which change state (e.g., liquid/gas) at a convenient pressure at a temperature which is in the vicinity of the range of ambient temperatures which may be expected to occur under normal conditions of installation and operation of the system. Halocarbon refrigerants are generally preferred for closed systems.

The vortex-generating turbine, operatively disposed in the T-shaped housing acts in such a way that a centrifugal force brings about molecular thermal separation by means of a force equilibrium which gives rise to the two flows of gaseous working fluid, one having a greater temperature than the other, flowing in different directions.

Arranged at an end of the working fluid circuit in front of the entry of the gas into the aforementioned pressurizing tank are preferably check valves which prevent back flow of the gas from said tank.

Depending on the thermal and/or refrigerating power required, a single turbine assembly may be used, or a plurality of turbine assemblies arranged in battery form.

BRIEF DESCRIPTION OF DRAWINGS

These and other advantages and characteristics of the heating and cooling system will become evident from the following description, presented by reference to the accompanying drawings, and which comprises illustrative but not limitative examples of preferred forms of realization of the system.

In the drawings.

BEST MODE FOR CARRYING OUT THE INVENTION

Figure 1:
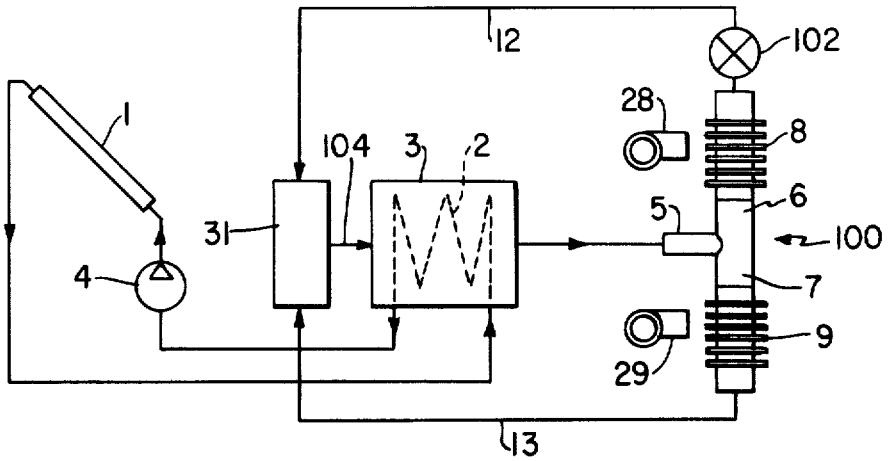
FIG. 1 is a schematic diagram of the heating and cooling system.

Referring now to FIG. 1, a primary source of heat includes a group of solar panels 1 which absorb solar radiation to raise the temperature of a heat-exchange fluid such as water. The heated heat-exchange fluid is pumped to a heat-exchanger coil 2 of a pressurizing tank 3 by means of a circulation pump 4. The pressurizing tank 3 contains a working fluid having a gaseous phase. Heat absorbed from the heat exchanger coil 2 brings about pressurization of the gas. As an example, the gas in the pressurizing tank 3 could be pressurized to a pressure of about 7 kg/cm$^2$.

Gas from the pressurizing tank 3 is injected under pressure into a turbine assembly 100. The turbine assembly 100 includes a T-shaped housing comprising an inlet conduit 5, a hot-flow arm 6 and a cold-flow arm 7. The hot-flow arm 6 and cold-flow arm 7 extend in opposing directions and carry the high and low temperature streams of working fluid, respectively. The turbine assembly 100 is described in detail below in connection with FIGS. 2 and 3.

Figure 4:
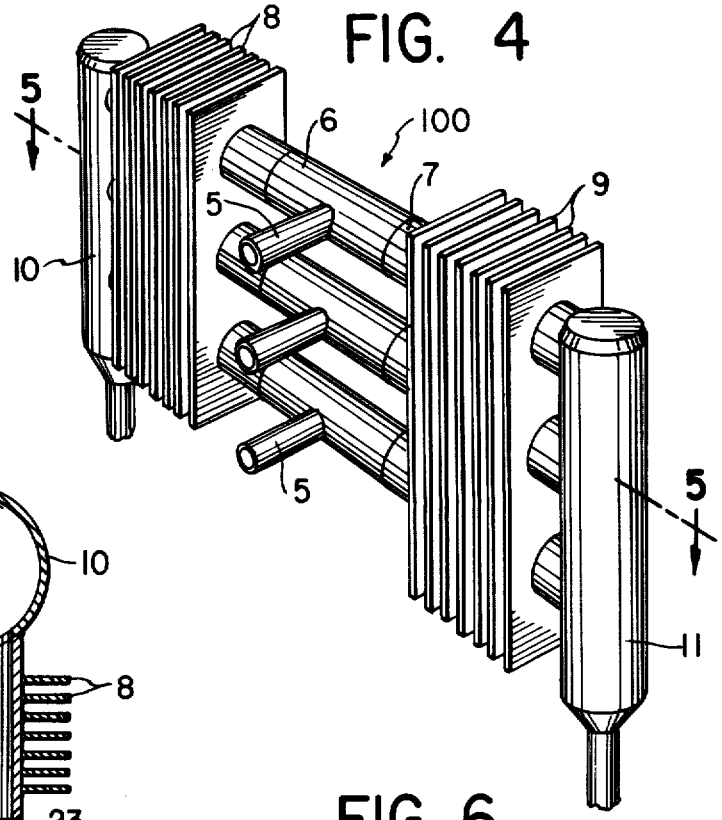
FIG. 4 is a perspective view of a first battery of turbine assemblies and heat exchangers.

The hot-flow arm 6 and the cold-flow arm 7 pass through and are in thermal contact with fin-type heat exchangers 8 and 9, respectively. A flow regulator such as flow-regulating valve 102 is connected in series with the hot-flow arm 6. As shown in FIG. 4, if more than one turbine assembly 100 is used, a hot-flow end collector 10 and a cold-flow end collector 11 can be connected respectively to the hot-flow and cold-flow arms 6 and 7, of the turbine assemblies for receiving gas streams from the arms. Returning to FIG. 1, a first return conduit 12 is connected between the hot-flow arm 6 and an input chamber of a pump 31. A second return conduit 13 is connected between the cold-flow arm 7 and the input chamber of the pump 31. The output of the pump 31 is connected to the pressurizing tank 3 by an input conduit 104.

Figure 2:
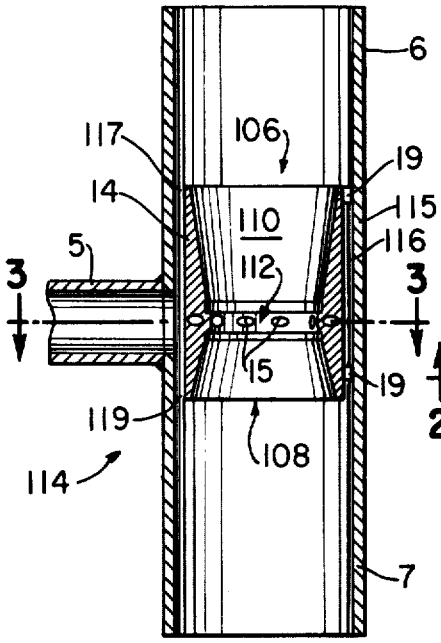
FIG. 2 is a cross-sectional view along line 2—2 of FIG. 3 of a turbine assembly.

Turning now to FIG. 2, a T-shaped housing 114 includes a turbine-sleeve conduit 115 and an inlet conduit 5 which extends generally perpendicular to the turbine-sleeve conduit. The inlet conduit 5 is joined to the turbine-sleeve conduit so that the interiors of the two conduits are in communication through an inlet discharge opening 118. The inlet conduit 5 provides an inlet to the turbine assembly 100. A length of the turbine-sleeve conduit 115 extending in one direction from the point of intersection of the two conduits defines a hot-flow arm 6 of the turbine assembly 100. A length of the turbine-sleeve conduit 115 extending from the point of intersection of the two conduits in a direction opposite from the hot-flow arm 6 defines a cold-flow arm 7 of the turbine assembly 100.

A turbine 14 is positioned in the T-shaped housing 114 generally coaxially with the turbine-sleeve conduit 115 approximately at the point of intersection of the turbine-sleeve and inlet conduits 115 and 5. The turbine 14 has a hot-gas discharge opening 106 at one end and a cold-gas discharge opening 108 at an opposite end. A generally axially-symmetric passageway 110 extends between the hot-gas discharge opening 106 and the cold-gas discharge opening 108. The diameter of the passageway varies from a minimum value at a throat 112 to greater values at the hot-gas and cold-gas discharge openings 106 and 108. Thus the passageway 110 is in the shape of a double Venturi tube. The throat 112 is located at a position axially intermediate between the cold-gas discharge opening 108 and the mid-point between the hot-gas and cold-gas discharge openings 106 and 108. Thus the axial distance from the throat 112 to the hot-gas discharge opening 106 is significantly greater than the axial distance from the throat 112 to the cold-gas discharge opening 108.

Figure 3:
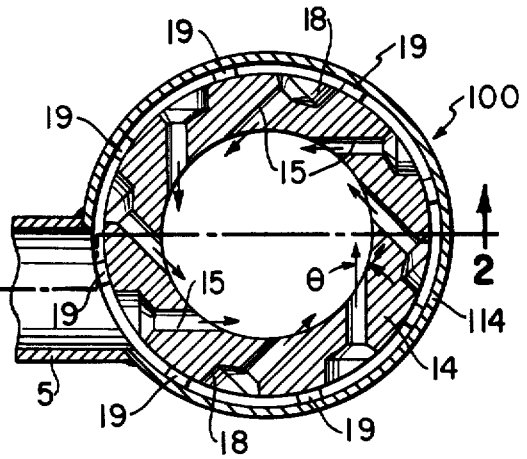
FIG. 3 is a view taken along line 3—3 of FIG. 2.

As seen best in FIG. 3, a plurality of gas-injection channels 15 extend from a radially-outer surface of the turbine 14 to a radially-inner surface at the throat 112. The gas-injection channels 15 extend generally parallel to a normal plane perpendicular to the axis of the passageway 110 and are spaced apart circumferentially around the turbine 14. An intersection angle $\theta$ is defined for each gas-injection channel 15 by the angle between a direction of approach of the gas-injection channel 15 to the inside surface of the turbine 14 and a tangent to the inside surface at a point of intersection of the direction of approach and the inside surface, the tangent being parallel to the normal plane. The intersection angle for each gas-injection channel 15 is an acute angle, the intersection angles being measured in a common sense proceeding around the inside surface of the turbine in one direction or the other. Thus gas flowing into the passageway 110 through the gas-injection channels 15 tends to flow in a vortical pattern. Preferably, the intersection angles of the gas-injection channels 15 are approximately equal. At that end of each gas-injection channel 15 which passes through the radially outer surface of the turbine 14, an inside diameter of the channel is enlarged to define an end chamber 18.

Turning again to FIG. 2, the turbine 14 is mounted within the turbine-sleeve conduit 115 by a plurality of tabs 19 which project radially outwardly from the outer surface of the turbine 14. An annular space between an inner surface of the turbine-sleeve conduit 115 and the outer surface of the turbine 14 defines a gas-distribution duct 116. The gas-distribution duct 116 communicates with the interior of the hot and cold flow arms 6 and 7 through first and second turbine-bypass openings 117 and 119 respectively.

The inlet conduit 5 preferably has a smaller diameter than the turbine-sleeve conduit 115 to which it is joined. The turbine 14 is positioned in the turbine-sleeve conduit 115 so that a central axis of the inlet conduit 5 lies approximately in the normal plane of the throat 112 of the turbine 14, as may be seen in FIG. 2. As shown best in FIG. 3, the central axis of the inlet conduit 5 is offset a significant distance from a central axis of the turbine conduit 115. In other words, the angle of intersection of the central axis of the inlet conduit 5 with the inside surface of the turbine-sleeve conduit 115 is an acute angle when measured in the sense in which the intersection angles of the gas-injection channels 15 are acute angles.

Figure 5:
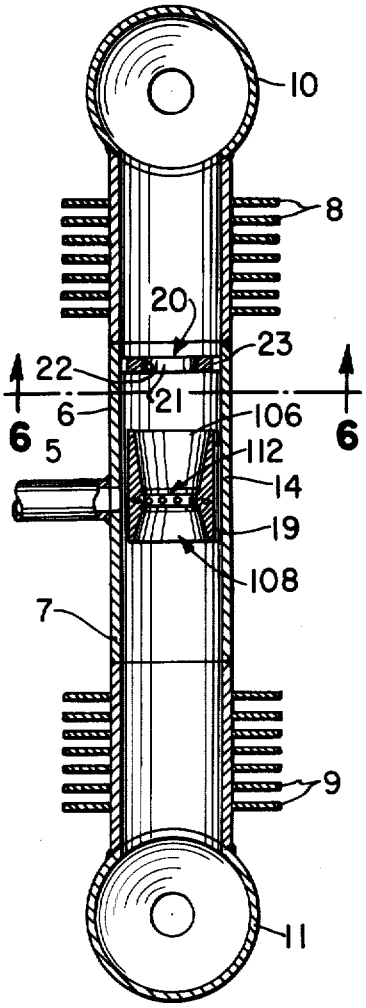
FIG. 5 is a cross-sectional view taken along line 5—5 of FIG. 4.
Figure 6:
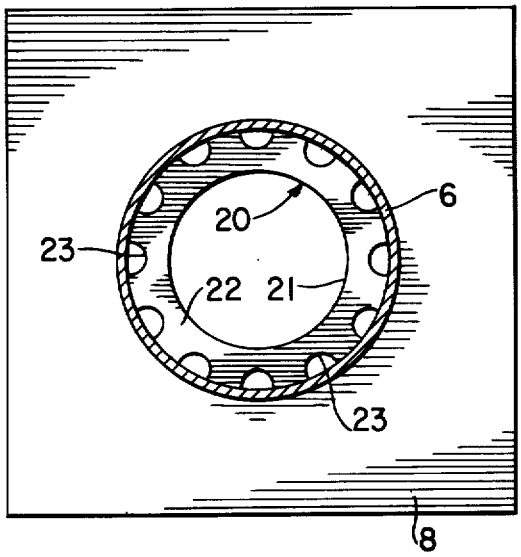
FIG. 6 is a cross-sectional view taken along line 6—6 of FIG. 5 of a flow throttle.

As shown in FIG. 5, a flow throttle 20 can be placed in a hot-flow arm 6 in a downstream direction from the hot-gas discharge opening 106 of a turbine 14. By regulating the pressure and rate of flow of the gaseous working fluid in the hot-flow arm 6, the temperature of the gas in the arm can be controlled. Generally, the greater the rate of flow of gas in the hot-flow arm 6, the higher the temperature. Flow throttle 20, illustrated in FIG. 6, includes a throttle ring 22 attached to the inside surface of the hot-flow arm 6. The throttle ring 22 has a central orifice 21 passing through it. The outer periphery of the throttle ring 22 is shaped to provide a plurality of semilunar radial windows 23 spaced around the periphery.

Figure 7:
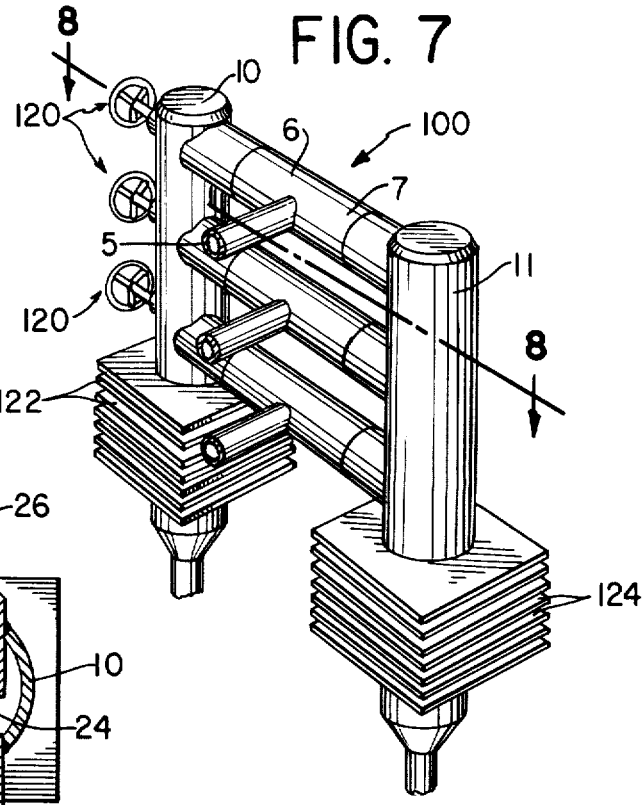
FIG. 7 is a perspective view of a second battery of turbine assemblies and heat exchangers.
Figure 8:
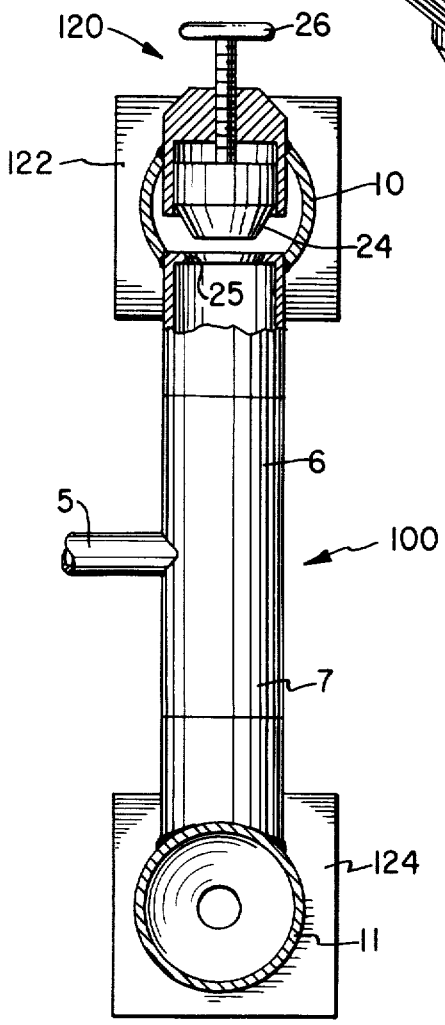
FIG. 8 is a partial cross-sectional view taken along line 8—8 of FIG. 7.

An alternate mechanism for regulating the pressure and rate of flow of gaseous working fluid in a hot-flow arm 6 is illustrated by the apparatus of FIGS. 7 and 8. An obturator or adjustable valve 120 is mounted at an end of a hot-flow arm 6. A valve plug 24 can be inserted within a valve seat 25 by an adjustable screw mechanism 26 to regulate the flow of gas through the valve seat. The adjustable valve 120 has an advantage over the flow throttle 20 in that the adjustable valve 120 permits the pressure and rate of flow of the gas in the hot-flow arm to be changed conveniently. Once in place, it is more difficult to change the flow throttle 20.

To facilitate transfer of heat between a surrounding atmosphere and gas flowing in the hot-flow arm 6, a fin-type heat exchanger 8 can be mounted on the arm in thermal contact with the arm, as shown in FIG. 4. A similar fin-type heat exchanger 9 can be mounted on the cold-flow arm 7 to facilitate the transfer of heat between the gas in the arm and a surrounding atmosphere. Fans 28 and 29 can be used to direct flowing air across the heat exchangers 8 and 9, respectively, as shown in FIG. 1.

Heat exchangers can also be mounted on the end collectors 10 and 11, as illustrated in FIG. 7. A first fin-type heat exchanger 122 is mounted on the hot-flow end collector 10 in thermal contact with the end collector. Similarly, a second fin-type heat exchanger 124 is mounted on the cold-flow end collector 11.

Figure 9:
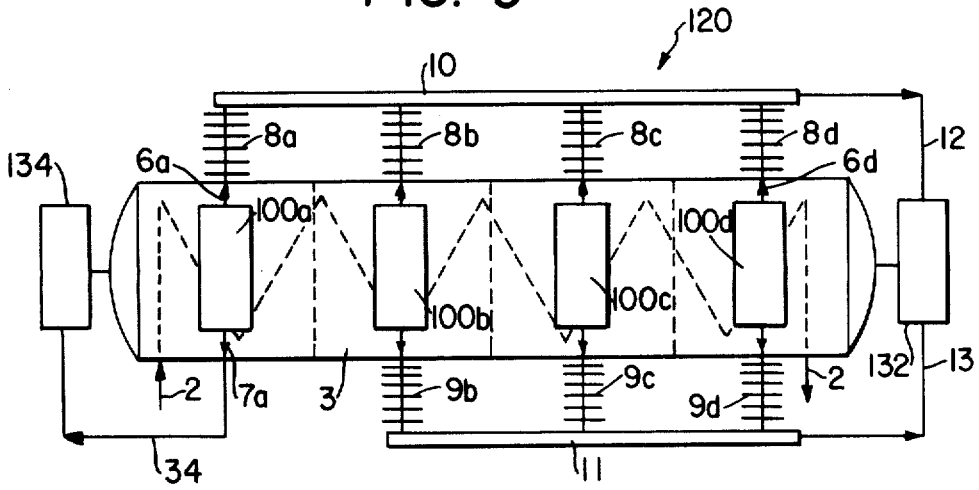
FIGS. 9, 10, and 11 are respectively schematic top, side and front views of a closed-circuit heating and cooling system.
Figure 10:
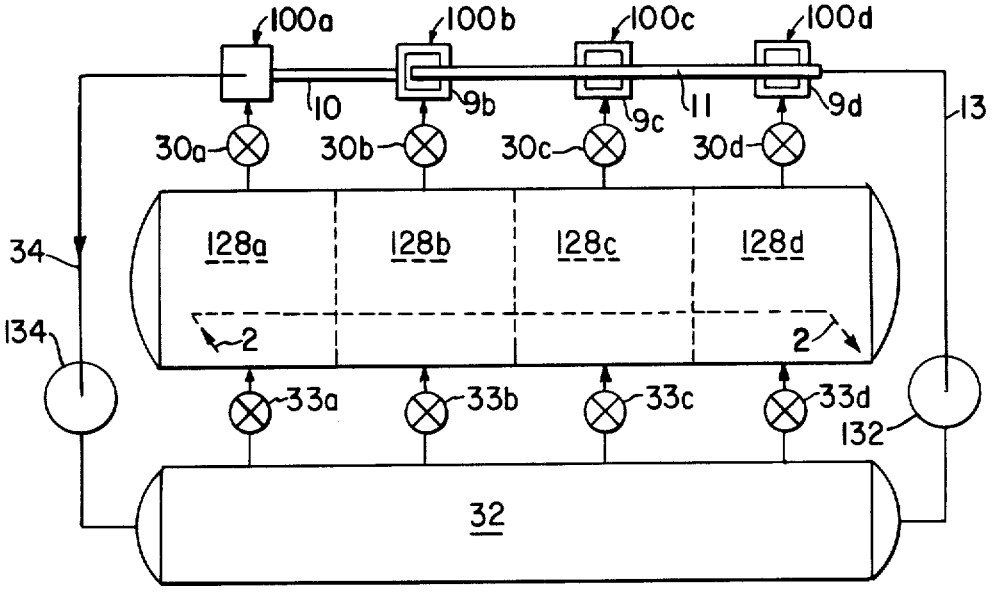
Figure 11:
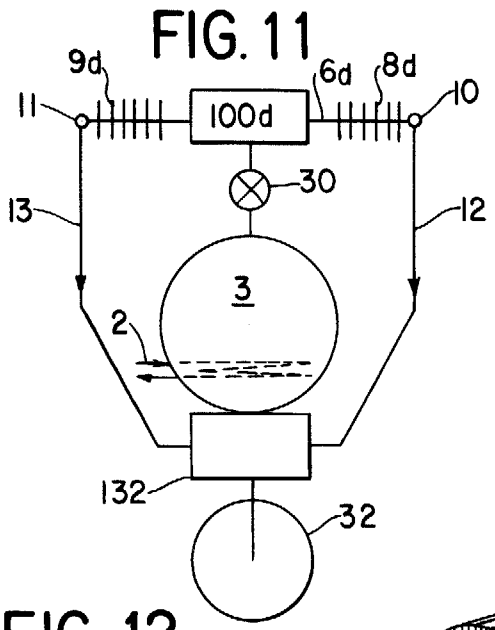

A closed heating and cooling system of the invention is illustrated schematically in FIGS. 9, 10, and 11. The system includes a pressurizing tank 3 which is divided internally into four compartments 128*a*, 128*b*, 128*c*, and 128*d*. A heat-exchanger coil 2 is located within the pressurizing tank 3 for transferring heat from a heat-transfer fluid flowing within the heat-exchanger coil 2 to a working fluid within the compartments 128*a–d* of the pressurizing tank 3. The heat-transfer fluid is heated by a primary heat source (not shown), such as a solar energy collector. As an example, the heat-transfer fluid could be water heated to about 20° C. The working fluid could be, for example, an azeotrope known as refrigerant number 502, which is made up of about 48.8 percent chlorodifluoromethane and about 51.2 percent chloropentafluoroethane.

Four control valves 30*a–d* connect respectively the four compartments 128*a–d* to the inlets of four turbine assemblies 100*a–d*. The hot-flow arms 6*a–d* of the four turbine assemblies 100*a–d* pass through fin-type heat exchangers 8*a–d* and are connected to a hot-flow end collector 10. A cold-flow end collector 11 is connected to the cold-flow arms 7*b*, 7*c*, and 7*d* of three of the turbine assemblies 100*b*, 100*c*, and 100*d*. A first return conduit 12 connects the hot-flow end collector 10 to a first input of a first pump 132. A second return conduit 13 connects the cold-flow end collector 11 to a second input of the first pump 132. The output of first pump 132 is connected to a cooling tank 32, in which the working fluid is liquified. The cold-flow arm 7*a* of the turbine assembly 100*a* is connected by a conduit 34 to a pump 134, which in turn is connected to the cooling tank 32. The cold flow from the turbine assembly 100*a* provides at least a portion of the cooling for the cooling tank 32. Input valves 33*a–d* connect the four compartments 128*a–d* with the cooling tank 32.

A set of preferred operating conditions for the system of FIGS. 9, 10, and 11 is set forth below. It will be appreciated that other operating conditions may be employed.

As noted above, a preferred heat-transfer fluid for the heat exchanger coil 2 is water and a preferred working fluid is the azeotropic refrigerant number 502.

In operation, a quantity of cooled working fluid is admitted into a compartment 128 of the pressurizing tank 3 from the cooling tank 32 by opening a corresponding input valve 33. With both the input valve 33 and the control valve 30 closed, the working fluid in the compartment 128 is heated to a temperature of about 20° C. by heat from the heat exchanger coil 2. The quantity of working fluid in the compartment 128 is chosen so that a gaseous phase is present in the compartment which has a pressure of about 7 kg/cm$^2$ at about 20° C.

After the working fluid in the compartment 128 has been heated to about 20° C., the corresponding control valve 30 is opened, which permits gaseous working fluid to expand adiabatically through the valve and flow into a turbine assembly 100 through the inlet conduit 5. Flow of the gaseous working fluid through the turbine 14 in the turbine assembly 100 produces a turbulence at the throat 112 of the turbine 14. Although the precise flow pattern is not known with certainty, the turbulent flow is thought to have axial refluxing as well as vortical characteristics. The stream of gas is divided at the turbine 14 into two steams, one hotter than the other. For a turbine having an outer diameter of about 14 mm, a flow rate through the inlet 5 of about 200 l/sec or greater is generally preferred. Gas velocities of about twice the speed of sound can be attained within the turbine assembly 100.

The proportions of the total gas flow which pass respectively through the hot-flow arm 6 and the cold-flow arm 7 can be determined over a wide range by the location and dimensions of a flow throttle 20, illustrated in FIG. 5. This range can be extended if desired by installing a second flow throttle in series with the cold-flow arm 7. For a turbine 14 having an outer diameter of about 14 mm and for a total flow rate through the inlet 5 of about 200 l/sec, the gas flowing through the inlet having a temperature of about 7° C., setting the flow in the hot-flow arm 6 to about 120 l/sec and the flow in the cold-flow arm 7 to about 90 l/sec results in a temperature of about 85° C. in the hot-flow arm and about −18° C. in the cold-flow arm.

Heat can be exchanged between the environment and the two streams by means of the fin-type heat exchangers 8 and 9. Gaseous working fluid from the hot-flow and cold-flow arms is pumped into the cooling tank 32 under pressure by pumps 132 and 134, where the working fluid is liquified. The gaseous working fluid from the cold-flow arm 7*a* of the turbine assembly 100*a* is not heated by passing through a fin-type heat exchanger 9, but is pumped directly into the cooling tank 32 to assist in cooling the working fluid in the tank to liquify it.

The heating and cooling system of FIGS. 9, 10, and 11 can be operated cyclically by heating a quantity of working fluid in a compartment 128, opening the corresponding control valve 30 and allowing the working fluid to flow through a turbine assembly 100 and be pumped into the cooling tank 32, closing the control valve 30 and introducing an equal quantity of working fluid into the compartment 128 for heating, thereby returning the cycle to its starting point. For the apparatus described above, the cycle can be repeated as often as about once every seven minutes.

The heating and refrigeration system of the present invention can be operated as an open system as well as a closed system. Generally, the thermal yield of the system can be optimized to higher values when the system is operated as a closed system, since a working fluid can be chosen having change of state characteristics which match the temperature of the primary heat source. However, there may be applications in which it is advantageous to employ an open system, particularly since air can be used as the working fluid. If air is used as the working fluid, it is preferable to have a supply of air at a roughly constant temperature above approximately 15° C. For example, air heated by passing it through a radiator of an automobile could serve as the working fluid.

Figure 12:
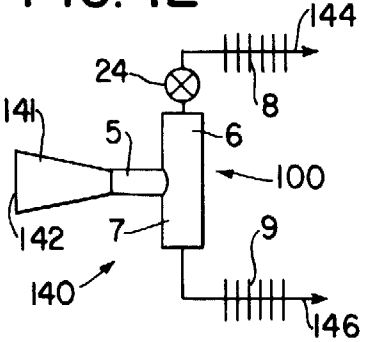
FIG. 12 is a schematic diagram of an open-circuit system.

An open heating and cooling system is illustrated schematically in FIG. 12. A heating and refrigeration system 140 includes a funnel-shaped air intake 141 connected at a discharge end to an inlet conduit 5 of a turbine assembly 100. The turbine assembly 100 is essentially the same as that discussed above in connection with FIG. 2. The intake 141 has a mouth 142 for receiving a stream of air. The converging shape of the intake 141 is adapted to accelerate a stream of air flowing into the mouth 142 of the intake to a relatively high velocity, much like the action of a wind tunnel. The relatively high-velocity stream of air passes into the turbine assembly, where it is divided into a hot-flow stream and a cold-flow stream flowing respectively in the hot-flow arm 6 and the cold-flow arm 7. A control valve 24 is connected in series with the hot-flow arm 6 for controlling the pressure and rate of flow at the hot-flow discharge port of the turbine 14 (not shown) mounted within the turbine assembly 100. The hot-flow arm 6 terminates at a hot-flow discharge port 144. A fin-type heat exchanger 8 is mounted on the hot-flow arm 6 between the control valve 24 and the discharge port 144. Similarly, the cold-flow arm 7 terminates in a cold-flow discharge port 146. Upstream of the cold-flow discharge port 146 is a fin-type heat exchanger 9.

Figure 13:
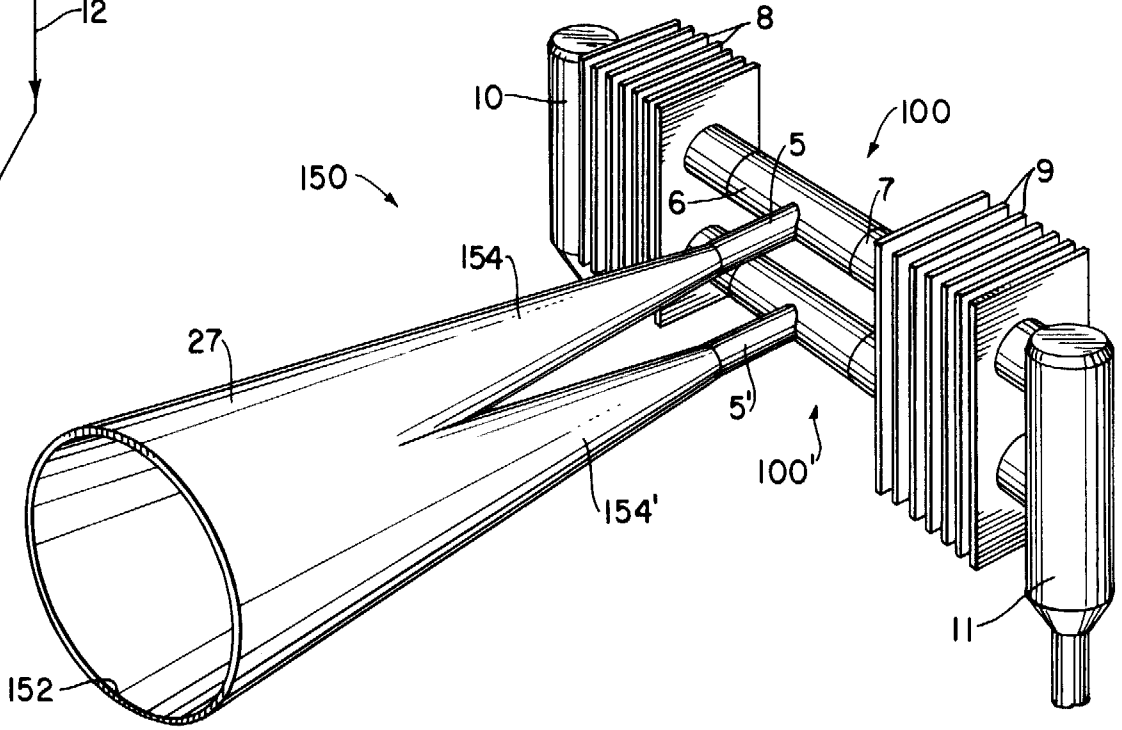
FIG. 13 is a perspective view of a third battery of turbine assemblies provided with an air intake.

Referring now to FIG. 13, an open heating and refrigeration system 150 includes a first and a second turbine assembly 100 and 100'. An air intake 27 has a mouth 152 for receiving a stream of air. The air intake 27 divides into a first branch 154 and a second branch 154'. The first branch 154 is connected to the inlet conduit 5 of the first turbine assembly 100. The second branch 154' is similarly connected to the inlet conduit 5' of the second turbine assembly 100'. The two turbine assemblies are connected to end collectors as discussed generally in connection with FIG. 4. For conciseness, that discussion will not be repeated here.

In operation, a stream of air; from an automobile radiator fan positioned in front of the mouth 152 of the intake 27, for example; enters the intake 27 through the mouth 152. Because of the converging shape of the intake 27, the air is discharged into the inlet conduits 5 and 5' at a relatively high velocity. The two air streams from the intake 27 are divided by the two turbine assemblies 100 and 100' into hot flow and cold-flow streams as described above. The hot-flow and cold flow streams could be used, for example, in heating and cooling the passenger compartment of the automobile.

The turbine assembly 100 of the present invention can be used to effect a density separation as well as a thermal separation. Thus, for example, if a stream of air is injected into an inlet conduit 5 of a turbine assembly 100 at a high velocity, the two streams of gas flowing in the hot-flow arm and the cold-flow arm differ from one another in composition. In particular, one stream is enriched in oxygen and the other is correspondingly depleted in oxygen. Thus the present invention can be used to generate a stream of gas enriched in oxygen relative to air.

It is not intended to limit the present invention to the specific embodiments described above. It is recognized that changes may be made in the apparatus described herein without departing from the scope and teachings of the instant invention. For example, heat sources other than solar collectors or automobile radiators may be employed as the primary heat source. Additional valves may be provided in series with the hot-flow arm, the cold-flow arm, and the return conduit to control flow rates and pressures throughout the heating and refrigeration system as desired. The turbine can vary greatly in size; from 10 mm or less to 1 m or more in diameter. Virtually any gas can be used as the working fluid in the heating and refrigeration system of the invention, although the thermal yield will in general depend upon the working fluid used. It is intended to encompass all other embodiments, alternatives and modifications consistent with the present invention.

I claim:

1. A turbine assembly for dividing an input stream of gas into a first and a second output stream of gas, the first output stream having a higher temperature than the second output stream, the turbine assembly comprising:

(a) a generally gas-tight housing having:

(a.1) an inlet conduit for directing a high-velocity stream of gas constituting the input stream into the interior of the housing, the inlet conduit having an inlet discharge opening through which the input stream can flow into the interior;

(a.2) a hot-flow outlet opening for discharging the first output stream; and (a.3) a cold-flow outlet opening for discharging the second output stream;

(b) a turbine located within the housing, the turbine having a passageway extending through it between a first discharge opening and a second discharge opening, the passageway being generally axially-symmetric in shape and having a throat defined by a region with a smallest diameter within the passageway, the axial distance from the throat to the first discharge opening being significantly greater than the axial distance from the throat to the second discharge opening, the diameter of the passageway increasing generally uniformly from the throat to either discharge opening, the turbine having a plurality of gas-injection channels passing through a wall of the turbine from an outer surface of the turbine to an inner passageway surface defining the passageway, the intersection of the gas-injection channels with the passageway surface defining a plurality of gas-injection ports for introducing gas into the passageway, the gas-injection ports being located in the vicinity of the throat of the passageway and spaced apart azimuthally about the passageway, each gas-injection channel defining a gas-injection direction by the direction of approach of the gas-injection channel to the corresponding gas-injection port, the gas-injection directions being oriented generally symmetrically with respect to a normal plane perpendicular to the axis of the passageway and passing through the throat, directed tangents to the passgeway surface being defined at each gas-injection port, the directed tangents extending parallel to the normal plane and being oriented to define collectively a direction of circulation in the passageway of the turbine, each gas-injection channel defining an interception angle between the gas-injection direction and the directed tangent defined at the gas-injection port, the interception angles being acute angles so that gas injected into the passageway of the turbine through the gas-injection channel tends to flow in a vortical pattern, each gas-injection channel being enlarged in an inner transverse dimension to define an end chamber at the end of the channel which intercepts the outer surface, the intersection of each end chamber with the outer surface of the turbine defining an end-chamber port for receiving gas to flow through the gas-injection channel, the end-chamber ports being spaced apart azimuthally about the outer surface in the vicinity of the normal plane; and (c) attachment means for mounting the turbine within the housing, the turbine being positioned so that the throat of the turbine communicates with the hot-flow outlet opening of the housing through the first discharge opening of the turbine, and communicates with the cold-flow outlet opening of the housing through the second discharge opening of the turbine, the inlet conduit of the housing defining an inlet injection direction by the direction of approach of the inlet conduit to the inlet discharge opening, the inlet-injection direction being oriented so that a line extending along the inlet-injection direction at least approximately lies in the normal plane of the turbine and is offset a significant distance from the axis of the passageway, the direction of the offset being such that a gas flow along the inlet-injection direction tends to reinforce a vortical flow pattern circulating in the sense defined by the directed tangents associated with the gas-injection ports of the turbine, an outer surface of the turbine through which the end-chamber ports pass being spaced apart from an inner surface of the housing to define a gas distribution duct, the gas-distribution duct communicating with the hot-flow outlet opening through a first turbine-bypass opening and with the cold-flow outlet opening through a second turbine-bypass opening, the gas-distribution duct thereby providing communication between the inlet discharge opening of the inlet conduit and the end-chamber ports of the turbine and the hot and cold flow openings of the housing.

2. A turbine assembly according to claim 1 in which the gas-injection channels lie substantially in the normal plane.

3. The turbine assembly according to claim 2 in which the housing comprises a turbine-sleeve conduit and the inlet conduit, an opening at one end of the turbine-sleeve conduit serving as the hot-flow outlet opening and an opening at the opposite end serving as the cold-flow outlet opening, the turbine-sleeve conduit being generally circular in cross section, the outer surface of the turbine being generally cyclindrical in shape and coaxial with the passageway, an outer diameter of the turbine being less than an inside diameter of the turbine-sleeve conduit, the turbine being mounted coaxially within the turbine-sleeve conduit.

4. The turbine assembly according to claim 3 in which a length of the turbine-sleeve conduit extending from the normal place to the hot-flow outlet opening defines a hot-flow arm and a length of the turbine-sleeve conduit extending from the normal plane to the cold-flow outlet opening defines a cold flow arm, and the turbine assembly further comprises:

(d) a fixed flow throttle mounted within the hot-flow arm for setting the rate of flow of gas through the hot flow arm to a preselected valve.

5. The turbine assembly according to claim 3 in which a length of the turbine-sleeve conduit extending from the normal plane to the hot-flow outlet opening defines a hot-flow arm and a length of the turbine-sleeve conduit extending from the normal plane to the cold-flow outlet opening defines a cold-flow arm, and the turbine assembly further comprises:

(d') an adjustable valve connected in series with the hot-flow arm for adjusting the rate of flow of gas through the hot-flow arm.

6. The turbine assembly according to either claims 4 or 5 further comprising a first and a second heat exchanger in thermal contact with the hot-flow and cold-flow arms respectively.

7. The turbine assembly according to claim 6 further comprising:

(e) an air intake connected to the inlet conduit for directing a stream of air into the inlet conduit, the air intake generally converging in shape from an intake opening for receiving an air flow to a discharge opening connected to the inlet conduit.

8. A heating and refrigeration system including:

(a) a pressurizing tank for containing a working fluid under pressure;

(b) a heat source in thermal communication with the pressurizing tank for heating the contents of the tank;

(c) a turbine assembly connected to the pressurizing tank for dividing an input stream of gaseous working fluid from the pressurizing tank into a first and a second output stream of gas, the first output stream having a higher temperature than the second output stream, the turbine assembly comprising:

(c.1) a generally gas-tight housing having:

(i) an inlet conduit for directing a high-velocity stream of gas constituting the input stream into the interior of the housing, the inlet conduit having an inlet discharge opening through which the input stream can flow into the interior;

(ii) a hot-flow outlet opening for discharging the first output stream; and (iii) a cold-flow outlet opening for discharging the second output stream;

(c.2) a turbine located within the housing, the turbine having a passageway extending through it between a first discharge opening and a second discharge opening, the passageway being generally axially-symmetric in shape and having a throat defined by a region with a smallest diameter within the passageway, the axial distance from the throat to the first discharge opening being significantly greater than the axial distance from the throat to the second discharge opening, the diameter of the passageway increasing generally uniformly from the throat to either discharge opening, the turbine having a plurality of gas-injection channels passing through a wall of the turbine from an outer surface of the turbine to an inner passageway surface defining the passageway, the intersection of the gas-injection channels with the passageway surface defining a plurality of gas-injection ports for introducing gas into the passageway, the gas-injection ports being located in the vicinity of the throat of the passageway and spaced apart azimuthally about the passageway, each gas-injection channel defining a gas-injection direction by the direction of approach of the gas-injection channel to the corresponding gas-injection port, the gas-injection directions being oriented generally symmetrically with respect to a normal plane perpendicular to the axis of the passageway and passing through the throat, directed tangents to the passageway surface being defined at each gas-injection port, the directed tangents extending parallel to the normal plane and being oriented to define collectively a direction of circulation in the passageway of the turbine, each gas-injection channel defining an interception angle between the gas-injection direction and the directed tangent defined at the gas-injection port, the interception angles being acute angles so that gas injected into the passageway of the turbine through the gas-injection channel tends to flow in a vortical pattern, each gas-injection channel being enlarged in an inner transverse dimension to define an end chamber at the end of the channel which intercepts the outer surface, the intersection of each end chamber with the outer surface of the turbine defining an end-chamber port for receiving gas to flow through the gas-injection channel, the end-chamber ports being spaced apart azimuthally about the outer surface in the vicinity of the normal plane; and (c.3) attachment means for mounting the turbine within the housing, the turbine being positioned so that the throat of the turbine communicates with the hot-flow outlet opening of the housing through the first discharge opening of the turbine, and communicates with the cold-flow outlet opening of the housing through the second discharge opening of the turbine, the inlet conduit of the housing defining an inlet injection direction by the direction of approach of the inlet conduit to the inlet discharge opening, the inlet-injection direction being oriented so that a line extending along the inlet-injection direction at least approximately lies in the normal plane of the turbine and is offset a significant distance from the axis of the passageway, the direction of the offset being such that a gas flow along the inlet-injection direction tends to reinforce a vortical flow pattern circulating in the sense defined by the directed tangents associated with the gas-injection ports of the turbine, an outer surface of the turbine through which the end-chamber ports pass being spaced apart from an inner surface of the housing to define a gas distribution duct, the gas-distribution duct communicating with the hot-flow outlet opening through a first turbine-bypass opening and with the cold-flow outlet opening through a second turbine-bypass opening, the gas-distribution duct thereby providing communication between the inlet discharge opening of the inlet conduit and the end-chamber ports of the turbine and the hot and cold flow openings of the housing;

(d) flow regulation means located in a downstream direction from the first discharge opening of the turbine for influencing the pressure and flow velocity of gas flowing from the first discharge opening;

(e) a first heat exchanger located in a downstream direction from the first discharge opening of the turbine adapted to exhange heat with a first gas stream flowing from the first discharge opening;

(f) a second heat exchanger located in a downstream direction from the second discharge opening of the turbine adapted to exhange heat with a second gas stream flowing from the second discharge opening; and (g) pump means for returning gaseous working fluid to the pressurizing tank, the pump means having:

(g.1) a first pump inlet connected to the hot-flow outlet opening of the housing of the turbine assembly, (g.2) a second pump inlet connected to the cold-flow outlet opening of the housing; and (g.3) a pump outlet connected to the pressurizing tank so that the two outlet streams of working fluid discharged from the turbine assembly are returned to the pressurizing tank.

9. The heating and refrigeration system according to claim 8 further comprising:

(h) a control valve connected between the pressurizing tank and the inlet conduit of the turbine assembly for controlling the flow of working fluid into the turbine assembly.

10. The heating and refrigeration system according to claim 9 further comprising:

(i) a cooling tank connected to the pump outlet of the pump means for storing working fluid for cooling to a liquid state; and (j) an input valve connected between the cooling tank and the pressurizing tank for controlling the flow of working fluid from the cooling tank to the pressurizing tank.

11. The heating and refrigeration system according to claim 10 in which the heat source includes a solar energy collector.

* * * * *

UNITED STATES PATENT AND TRADEMARK OFFICE

CERTIFICATE OF CORRECTION

PATENT NO. : 4,302,949

DATED : December 1, 1981

INVENTOR(S) : Antonio A. Trimboli Longhetto

It is certified that error appears in the above—identified patent and that said Letters Patent is hereby corrected as shown below:

Column 1, line 18 "attentuated" should read --attenuated--

Column 6, line 39 "steams" should read --streams--

Column 8, line 3 "hot flow" should read --hot-flow--

Column 8, line 4 "cold flow" should read --cold-flow--

Column 9, line 54 "gas distribution" should read --gas-distribution--

Column 10, line 16 "cold flow" should read --cold-flow--

Column 10, line 20 "hot flow" should read --hot-flow--

Column 10, line 20 "valve" should read --value--

Column 12, line 26 "exhange" should read --exchange--

Column 12, line 30 "exhange" should read --exchange--

Column 12, line 37 "assembly," should read --assembly;--

Signed and Sealed this

Ninth Day of March 1982

[SEAL]

*Attest:*

GERALD J. MOSSINGHOFF

*Attesting Officer* *Commissioner of Patents and Trademarks*